US010174733B2

(12) United States Patent
Thornthwaite et al.

(10) Patent No.: US 10,174,733 B2
(45) Date of Patent: Jan. 8, 2019

(54) OIL LUBRICATED COMMON RAIL DIESEL PUMP

(71) Applicant: DELPHI TECHNOLOGIES IP LIMITED, St. Michael (BB)

(72) Inventors: Ian Roy Thornthwaite, Gillingham (GB); Kevin J. Laity, Gillingham (GB); Richard Krause, Gillingham (GB)

(73) Assignee: DELPHI TECHNOLOGIES IP LIMITED (BB)

( * ) Notice: Subject to any disclaimer, the term of this patent is extended or adjusted under 35 U.S.C. 154(b) by 0 days.

(21) Appl. No.: 15/561,123

(22) PCT Filed: Feb. 26, 2016

(86) PCT No.: PCT/EP2016/054072
§ 371 (c)(1),
(2) Date: Sep. 25, 2017

(87) PCT Pub. No.: WO2016/150650
PCT Pub. Date: Sep. 29, 2016

(65) Prior Publication Data

US 2018/0128226 A1 May 10, 2018

(30) Foreign Application Priority Data

Mar. 26, 2015 (GB) ..... 1505089.1

(51) Int. Cl.
*F02M 59/10* (2006.01)
*F02M 59/44* (2006.01)
(Continued)

(52) U.S. Cl.
CPC ..... *F02M 59/102* (2013.01); *F02M 59/44* (2013.01); *F02M 59/442* (2013.01);
(Continued)

(58) Field of Classification Search
CPC .... F02M 59/102; F02M 59/44; F02M 59/442; F04B 1/0439; F04B 39/0284; F04B 39/0292; F04B 27/109
(Continued)

(56) References Cited

U.S. PATENT DOCUMENTS 4,754,737 A * 7/1988 Ishida ..... F02D 1/12 123/357
5,339,724 A * 8/1994 Rosgren ..... F02M 59/442 184/18
(Continued)

FOREIGN PATENT DOCUMENTS

DE 10 2010 042 509 A1 4/2012
DE 10 2012 204 264 A1 9/2013
(Continued)

*Primary Examiner* — Mahmoud Gimie
(74) *Attorney, Agent, or Firm* — Joshua M. Haines

(57) ABSTRACT

An oil lubricated common rail diesel pump includes a pumping assembly and a drivetrain assembly. The pumping assembly includes a pump housing and a plunger mounted along a pumping axis. The drivetrain assembly includes a driveshaft and a cam mounted within a first chamber of a drivetrain housing. The plunger is arranged for reciprocating linear movement along the pumping axis within a second chamber of the housing upon rotation of the cam. The drivetrain assembly also includes a guide mounted within the housing between the cam and the plunger and being adapted to receive a cam follower. At least the housing is adapted to be substantially filled with oil in use and the guide includes at least one flow passage communicating between the first chamber and the second chamber.

13 Claims, 3 Drawing Sheets

(51) Int. Cl.

| | |
|---|---|
| ***F04B 39/02*** | (2006.01) |
| ***F04B 1/04*** | (2006.01) |
| *F02M 63/00* | (2006.01) |

(52) U.S. Cl.
CPC ..... *F04B 1/0426* (2013.01); *F04B 1/0439* (2013.01); *F04B 39/0284* (2013.01); *F04B 39/0292* (2013.01); *F02M 63/0001* (2013.01)

(58) Field of Classification Search
USPC ..... 123/495; 184/27.1; 92/165 R, 153
See application file for complete search history.

(56) References Cited

U.S. PATENT DOCUMENTS

| | | | | |
|---|---|---|---|---|
| 9,297,376 | B2 * | 3/2016 | Sakoh | F04B 53/14 |
| 2007/0128058 | A1 | 6/2007 | Kitamura | |
| 2008/0178845 | A1 | 7/2008 | Shimai | |
| 2011/0146626 | A1 | 6/2011 | Maruyama et al. | |
| 2016/0222934 | A1 * | 8/2016 | Oki | F02M 59/102 |

FOREIGN PATENT DOCUMENTS

| | | | | |
|---|---|---|---|---|
| DE | 102012218075 | A1 * | 4/2014 | F02M 63/0001 |
| EP | 2 657 505 | A1 | 10/2013 | |
| EP | 2 821 646 | A1 | 1/2015 | |
| JP | 2010-249101 | A | 11/2010 | |

* cited by examiner

OIL LUBRICATED COMMON RAIL DIESEL PUMP

CROSS REFERENCE TO RELATED APPLICATIONS

This application is a national stage application under 35 USC 371 of PCT Application No. PCT/EP2016/054072 having an international filing date of Feb. 26, 2016, which is designated in the United States and which claimed the benefit of GB Patent Application No. 1505089.1 filed on Mar. 26, 2015, the entire disclosures of each are hereby incorporated by reference in their entirety.

BACKGROUND

Technical Field

The present invention relates generally to the field of oil lubricated common rail diesel pumps. More particularly, but not exclusively, the present invention concerns an improved drivetrain assembly for an oil lubricated common rail diesel pump.

Description of the Related Art

The components of a common rail fuel injection system include a rail, a high pressure pump and fuel injectors. Radial, unit and in-line pumps are often used in such common rail fuel injection systems.

Unit pumps (UP) can be mounted on a cambox or directly within the engine. There is a current focus on the development of high pressure unit pump designs to achieve higher efficiency of the fuel injection system and to facilitate accurate rail pressure control.

The majority of common rail diesel fuel unit pumps are lubricated using diesel fuel. In cases where high quality diesel fuel is utilised, fuel lubrication is satisfactory. However, in circumstances where poor quality diesel fuels are used for lubrication, for example in some countries of the world, lubrication is unsatisfactory, which impacts on pump performance and longevity.

Oil lubricated common rail diesel pumps are therefore, preferred since lubricity is not compromised as it can be using fuels. In addition, oil lubrication enables the pump to support higher loads and increased pumping forces at higher pressures.

However, oil lubrication can present its own challenges. In particular, where a pump housing becomes full of oil, this can result in large irregular pressure pulses at high pumping speeds. Pressure pulses of the magnitude observed in round tappet oil-lubricated housings can damage front driveshaft seals and can also result in oil being forced into the fuel circuit (past the pumping plunger) having a negative impact on the engine performance.

It is an object of the present invention to address one or more of the problems of the prior art as discussed herein or otherwise.

It is now desired to provide an improved arrangement for an oil lubricated drivetrain arrangement to drive an oil lubricated common rail diesel pump.

SUMMARY OF THE INVENTION

In a first aspect of the present invention there is provided an oil lubricated common rail diesel pump comprising a pumping assembly and a drivetrain assembly, the pumping assembly comprising a pump housing and a plunger mounted along a pumping axis, the drivetrain assembly comprising a driveshaft and a cam mounted within a first chamber of a drivetrain housing, the plunger being arranged for reciprocating linear movement along the pumping axis within a second chamber of the drivetrain housing upon rotation of the cam, the drivetrain assembly further comprising a guide mounted within the drivetrain housing between the cam and the plunger and being adapted to receive a cam follower for contact with a driven end of the plunger, wherein at least the drivetrain housing is adapted to be substantially filled with oil in use and the guide comprises at least one flow passage communicating between the first chamber and the second chamber of the drivetrain housing.

By 'the drivetrain housing is adapted to be substantially filled with oil in use', what is meant is the drivetrain housing is substantially full of oil during its operation in addition to being largely full of oil when the engine is stationary. At least the first chamber of the drivetrain housing is filled with oil.

By 'communicating between the first chamber and the second chamber', what is meant is a passage that is open to both the first chamber and the second chamber.

With this arrangement, the oil-filled drivetrain housing provides for immediate lubrication at engine cranking (thereby minimising any delay usually caused by the time for oil pressure rising), as well as removing the necessity for a forced flow of engine oil to the drivetrain assembly. A further advantage is that the pump can be mounted at a variety of angles within the engine and there is minimal limitation to engine tilt (and therefore vehicle tilt) during operation. Meanwhile, the improved guide minimises significant pressure pulses that can occur in oil-filled pump housings due to oil displacement events, by providing a passage for oil to flow back through during pumping events. This maintains the integrity of the seals and minimises oil being forced into the fuel pumping circuit to preserve engine performance.

Preferably, the flow passages and any outer channels adopt a substantially linear path between the first and second ends of the guide body. Alternatively, the flow passages and any outer channels may adopt a non-linear path.

Preferably, the guide comprises a guide body comprising first and second ends. Preferably, the guide body is substantially cylindrical between the first and second ends, although the guide body may be substantially cuboid, or another suitable shape. Preferably, the guide body is shaped to be mounted directly within a chamber of the drivetrain housing, although the guide body may be mounted in an adapter that is itself mounted directly within a chamber of the drivetrain housing. Preferably, the guide body is mounted coaxially with the pumping axis and is preferably mounted substantially within the second chamber. Preferably, the guide is press-fitted into the second chamber.

Preferably, the at least one flow passage extends between the first and second ends and is open at both ends.

Preferably, the, or each flow passage is disposed within a peripheral portion of the guide body. Preferably, therefore, the, or each flow passage is disposed in the guide body towards an outside wall or walls of the guide body. Alternatively, the, or each flow passage may be open to the outside wall or walls of the guide body.

Preferably, the guide comprises at least two flow passages. Preferably, the flow passages are located approximately opposite one another on the guide body.

The guide may comprise more than two flow passages. Preferably, the flow passages are approximately equally spaced from one another around the peripheral portion of the guide body. The equal spacing of the flow passages helps to provide balanced proportions of the guide body.

Preferably, the guide comprises an aperture extending between the first and second ends and open at both ends to provide guided sliding contact with the cam follower. Preferably, the aperture is substantially centrally located in the guide body. The central location of the aperture helps to provide accurate location of the cam follower within the aperture.

Preferably, the aperture comprises an inner channel. The aperture may comprise at least one outer channel.

The outer channel(s) may themselves be referred to as flow passages, and so may be additional to, or alternative to the previously described flow passage arrangement.

Preferably, both the inner channel and the outer channel(s) extend between the first and second ends.

The, or each outer channel is preferably provided around a periphery of the inner channel and communicate(s) with the inner channel between the first and second ends. In other words, the outer channel(s) is(are) substantially open to the inner channel between the first and second ends.

Preferably, the outer channel(s) are approximately equally spaced around the periphery of the inner channel. The equal spacing of the outer channels helps to provide balance to the guide body.

The outer channel(s) may be open to the inner channel along their full length.

Preferably, the inner channel comprises a shape that substantially corresponds with the external shape of a cam follower shoe of the cam follower. Preferably, where outer channels are present, the shape of the inner channel is defined by a plurality of disconnected internal walls.

By 'disconnected' what is meant is, not directly connected to one another, but indirectly connected by one or more other intervening walls, for example of the outer channel(s).

Where the inner channel comprises a substantially cuboidal shape, the inner channel is defined by a plurality of substantially straight internal walls, preferably four internal walls. Alternatively, where the inner channel comprises a substantially cylindrical shape, the inner channel is defined by one or a plurality of substantially curved internal walls, preferably a single internal wall.

Most preferably, the inner channel comprises a substantially rectangular prism defined by a pair of opposing shorter internal walls and a pair of opposing longer internal walls to provide guided sliding contact with a generally rectangular prism-shaped cam follower shoe.

The aperture preferably comprises four outer channels, one provided at each corner of the substantially rectangular prism-shaped inner channel. The aperture may comprise one, two, three or more outer channels as long as the integrity and the shape of the inner channel was neither compromised nor caused to be unsuitable with respect to the cam follower shoe.

Preferably, the flow passages are equally spaced around the periphery of the inner channel and between any outer channels. This allows for efficient spacing of the various passages and channels as well as aiding the balanced proportions of the guide body.

Preferably, the flow passages and any outer channels are contoured internally in order to minimise sharp edges and corners.

The flow passages and any outer channels preferably comprise a plurality of short internal walls arranged to provide a substantially curved internal shape. Alternatively, the flow passages and any outer channels may comprise a single smooth and continuous internal wall.

Preferably, the shape of the flow passages and any outer channels is chosen to maximise flow volume given the shape of the guide body and the aperture.

Preferably, with a cylindrically-shaped guide body, the flow passages and any outer channels adopt a substantially (curved) isosceles trapezoid prism shape.

Preferably, at junctions where the outer channels meet with the internal walls defining the inner channel, the outer channels comprise short outwardly-angled or curved walls.

Preferably, the drivetrain housing comprises a first part comprising the first chamber and a second part comprising the second chamber. The first and second chambers, are generally open to one another, e.g. flow of fluid is permissible between the chambers around the drive assembly and pumping assembly components.

Preferably, the second part of the drivetrain housing is substantially open-ended in order to receive and mount a lower part of the pump housing therein.

Preferably, the second part of the drivetrain housing is adapted to support an upper part of the pump housing.

Preferably, the first and second chambers of the drivetrain housing are substantially closed once assembled with the pump housing (except for inlets and outlets as appropriate). This allows for the majority of the drivetrain housing to be substantially filled with oil around the various components of the drivetrain assembly and accommodated components of the pump assembly.

Preferably, the first chamber of the drivetrain housing comprises a substantially cylindrical compartment of varying diameter across its length in order to mount the driveshaft and the cam therein.

Preferably, the second chamber of the drivetrain housing comprises a substantially cylindrical compartment of substantially equal diameter. The second chamber is preferably disposed perpendicularly to the first chamber so as to be generally upstanding above the cam. This arrangement provides for the pumping axis A-A' and a driveshaft rotational axis B-B' to be disposed substantially perpendicularly to one another.

Preferably, the drivetrain housing comprises at least one oil inlet adapted to deliver oil to the chambers of the drivetrain housing. Preferably, the oil inlet is disposed to deliver oil to the first chamber in the region of the cam.

Preferably, distribution of oil throughout the drivetrain housing comprises passive flow events, and specifically, bearings surfaces of the pump are cooled by passive cooling.

By 'passive flow events' what is meant is taking advantage of natural fluid hydrodynamics and passive cooling, to effect cooling of bearing surfaces.

Preferably, oil inlet pressure is between approximately 1.5 bar and approximately 4 bar. Preferably, the cambox pressure is atmospheric. Passive flow cooling of the bearing surfaces reduces the flow demand variation on the engine oil pump at different operating temperatures.

With passive cooling the controlled flow through the pump via the first orifice is not greatly affected by increases in temperature.

Alternatively, cooling of the bearing surfaces may be by forced flow. Forced flow refers to actively forcing a flow across the bearing surfaces, i.e. having a pressure difference across the bearing.

The forced flow may be effected by a conduit provided between said oil inlet and said first chamber in the region of the rear bearing/journal.

With forced flow cooling the controlled flow through the pump is viscous sensitive, so as the temperature increases, an increase in flow across the bearing puts a greater demand on the engine oil supply pump.

Preferably, the first chamber comprises a substantially circumferential space around the cam to accommodate a volume of oil.

Preferably, the first part of the drivetrain housing comprises at least one conduit between the circumferential space and other spaces within the first chamber to provide onward distribution of oil.

Preferably, the first part of the drivetrain housing comprises a first conduit between the circumferential space and a rear space, e.g. proximal to a rear journal and rear bearing of the driveshaft. Preferably, the first part of the drivetrain housing comprises a second conduit between the circumferential space and a front space, e.g. proximal to a front journal and front bearing of the driveshaft.

Preferably, distribution of oil to the second chamber comprises flow of oil from the first chamber. This flow of oil from the first chamber is facilitated primarily by the flow passages and/or the outer channels of the guide.

Preferably, the oil inlet is disposed so as to enter the first part of the housing towards a top of the first part of the drivetrain housing. The oil inlet may be angled into the first chamber.

Alternatively, the oil inlet may be provided so as to enter the first part of the housing at another location.

Preferably, the oil outlet is disposed in the second part of the drivetrain housing. Preferably, the oil outlet is disposed towards a top of the second part of the drivetrain housing.

Preferably both the oil inlet and the oil outlet are located above the moving cam follower components Locating the oil inlet and the oil outlet above the cam follower level ensures that the first chamber does not naturally fully drain of oil during stationary engine events.

Preferably, the oil inlet receives oil though a feed pipe from a cleaned source of oil, e.g. from the clean side of an oil filter within the engine. Preferably, the oil outlet returns oil though a feed pipe to an uncleaned source of oil, e.g. to a crankcase of the engine (not shown).

The oil inlet and associated feed pipe may be of smaller diameter than the oil outlet feed pipe. A pressurised flow of oil is provided into the housing, and a relatively (to the inward inlet flow) unrestricted flow of oil out of the housing is enabled.

The oil inlet may comprise a further oil filter before oil enters the drivetrain housing.

The cam follower preferably comprises a substantially rectangular prism cam follower shoe. The cam follower shoe is preferably sized to fit snugly within the inner channel as defined by the inner channel walls. Whilst the corners of the rectangular prism cam follower shoe are not bounded by walls as they move within the open volume of the outer channels, the internal walls of the inner channel are sufficient to retain a sliding engagement of the cam follower shoe within the inner channel and along the pumping axis without any significant lateral movement or twisting.

The use of a rectangular cam follower shoe enables a stable non-twisting sliding engagement with the guide, whilst providing a smaller footprint than a traditional round tappet. This smaller footprint of the cam follower shoe provides a lesser degree of fluid (oil) displacement within the chambers, of the drivetrain housing as it moves up and down the pumping axis.

Preferably, the cam follower comprises a sliding aid. The sliding aid may comprise a roller between the cam and the cam follower shoe. The roller may be partially housed within an internal cavity in an underside of the cam follower shoe. The roller and the cavity may comprise a cylindrical shape. The sliding aid sits atop the cam and eases the translation of the rotational movement of the cam to the linear reciprocating movement of the cam follower shoe and therefore, the plunger. As the cam rotates, the roller rides along the surface of the cam by spinning within the cavity of the cam follower shoe. This reduces the friction and the effort required to translate said rotational movement to the linear reciprocating movement.

The cam comprises a profile which, on rotation of the driveshaft, effects one or more reciprocations of the pumping plunger per revolution of the driveshaft. The cam could comprise, for example, a round profile which is eccentric to the driveshaft, or a non-round profile The drivetrain housing may be generally shaped to minimise the space taken up by the pump within an engine. As such, the housing may resemble a bisecting cylinder arrangement to reduce the volume of the housing within an engine.

With the above described arrangement, the cam follower shoe sits snugly within the inner channel of the guide. As the cam rotates (driven by rotation of the driveshaft), the roller rides along the cam to provide a low-friction, reciprocating linear movement along the pumping axis to the cam follower shoe in which the roller is partially housed, and thereon to the plunger. As the cam rotates, oil is naturally displaced within the cavity. Further oil displacement is caused by the linear movement of the cam follower (roller/cam follower shoe) as oil is forced upwardly within the second chamber by the solid body of the cam follower shoe. Any resultant pressure pulses are minimised since the flow passages provided within the guide reduce the impact of the oil displacement by allowing for oil to backflow relative to the cam follower shoe direction as opposed to being forced in one direction. Where outer channels are provided around the inner channel, these also allow oil to backflow relative to the cam follower shoe direction. Further control of the oil displacement is provided by the rectangular configuration of the cam follower shoe, which allows for a smaller cam follower shoe with sufficient surface area and load capacity to withstand the pumping events, thereby providing a smaller surface area and volume to effect oil displacement. Pressure fluctuations are therefore, kept to a minimum.

In the present invention, the oil-filled drivetrain housing ensures immediate lubrication is available following a stationary event, as opposed to waiting for oil pressure rises at a starting event. In addition, there are a variety of mounting angles available to the vehicle manufacturer and vehicle tilt is not limited due to the oil-filled housing.

In a second aspect of the present invention there is provided a drivetrain assembly for an oil lubricated common rail diesel pump, comprising a driveshaft and a cam mounted within a first chamber of a drivetrain housing, a second chamber of the drivetrain housing adapted to receive a reciprocating plunger, and a guide mounted within the drivetrain housing above the cam and being adapted to receive a cam follower shoe, wherein the drivetrain housing is adapted to be substantially filled with oil in use and the guide comprises at least one flow passage communicating between the first chamber and the second chamber of the drivetrain housing.

It will be appreciated that the preferred features described in relation to the first aspect of the invention apply to the second aspect of the invention.

In a third aspect of the present invention there is provided a guide of a drivetrain assembly for an oil lubricated common rail diesel pump, the guide being adapted to be mounted within a drivetrain housing above a cam and being adapted to receive a cam follower shoe, wherein the guide comprises at least one flow passage therethrough between a first and second end thereof.

It will be appreciated that the preferred features described in relation to the first and second aspects of the invention apply to the third aspect of the invention.

In a fourth aspect of the present invention there is provided a drivetrain assembly for an oil lubricated common rail diesel pump, comprising a driveshaft and a cam mounted within a first chamber of a drivetrain housing, a second chamber of the drivetrain housing adapted to receive a reciprocating plunger, and a guide mounted within the drivetrain housing above the cam and being adapted to receive a cam follower shoe, wherein the drivetrain housing is adapted to be substantially filled with oil in use and cooling of the bearings comprises passive flow events.

It will be appreciated that the preferred features described in relation to the first, second and third aspects of the invention apply to the fourth aspect of the invention.

BRIEF DESCRIPTION OF THE DRAWINGS

For a better understanding of the invention, and to show how exemplary embodiments may be carried into effect, reference will now be made to the accompanying drawings in which.

DETAILED DESCRIPTION OF THE EXEMPLARY EMBODIMENTS

Figure 1:
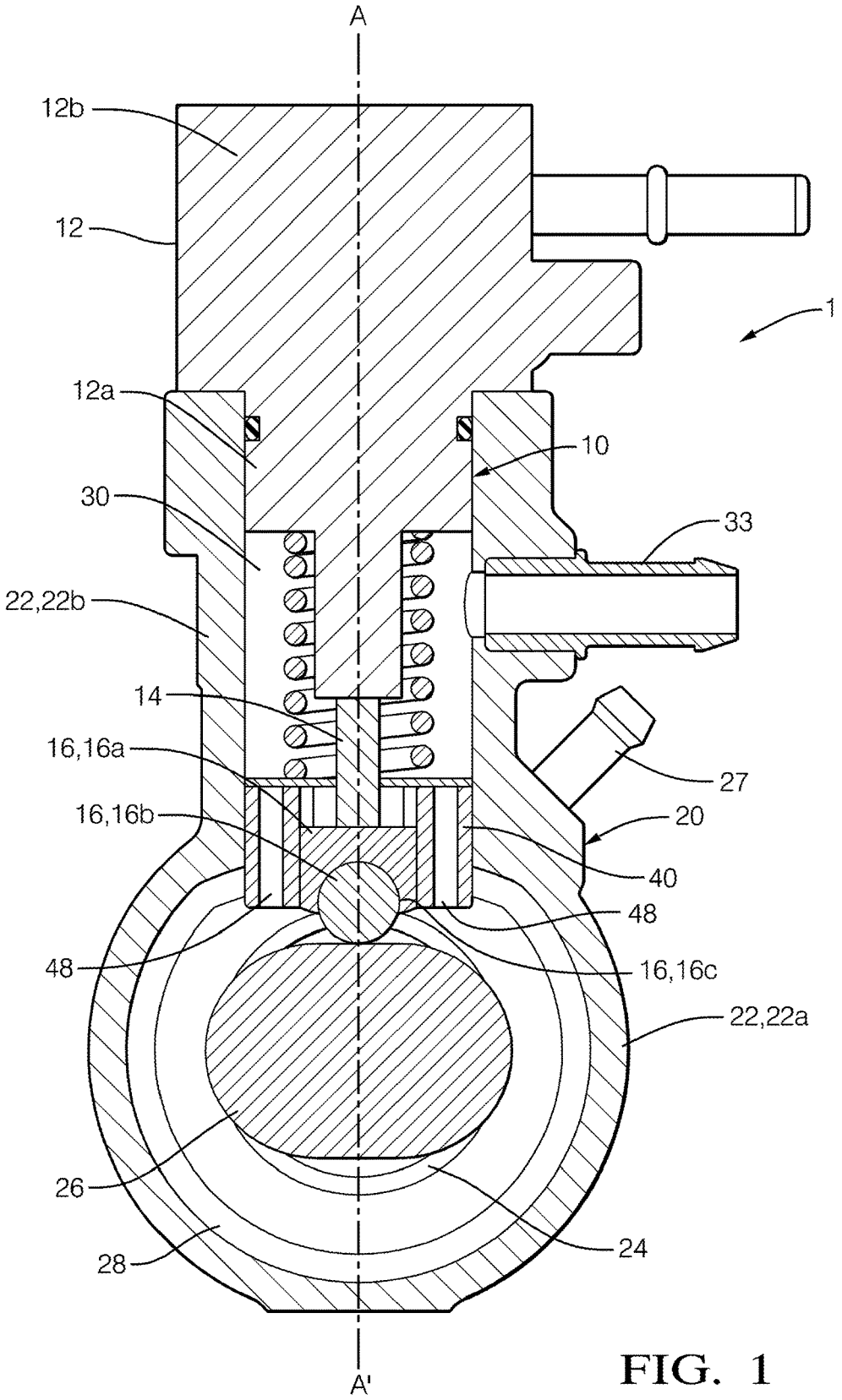
FIG. 1 is a schematic cross-sectional view of a common rail diesel pump comprising a drivetrain assembly according to an exemplary embodiment of the invention.

According to an exemplary embodiment of the invention, FIG. 1 shows an oil lubricated common rail diesel pump 1 comprising a pumping assembly 10 and a drivetrain assembly 20, the pumping assembly 10 comprising a pump housing 12 and a plunger 14 mounted along a pumping axis A-A', the drivetrain assembly 20 comprising a driveshaft 24 and a cam 26 mounted within a first chamber 28 of a drivetrain housing 22, the plunger 14 being arranged for reciprocating linear movement along the pumping axis A-A' within a second chamber 30 of the drivetrain housing 22 upon rotation of the cam 26, the drivetrain assembly 20 further comprising a guide 40 mounted within the drivetrain housing 22 between the cam 26 and the plunger 14 and being adapted to receive a cam follower 16*a*, 16*b*, wherein at least the drivetrain housing 22 is adapted to be substantially filled with oil in use and the guide 40 comprises at least one flow passage 48 communicating between the first chamber 28 and the second chamber 30 of the drivetrain housing 22.

Figure 2:
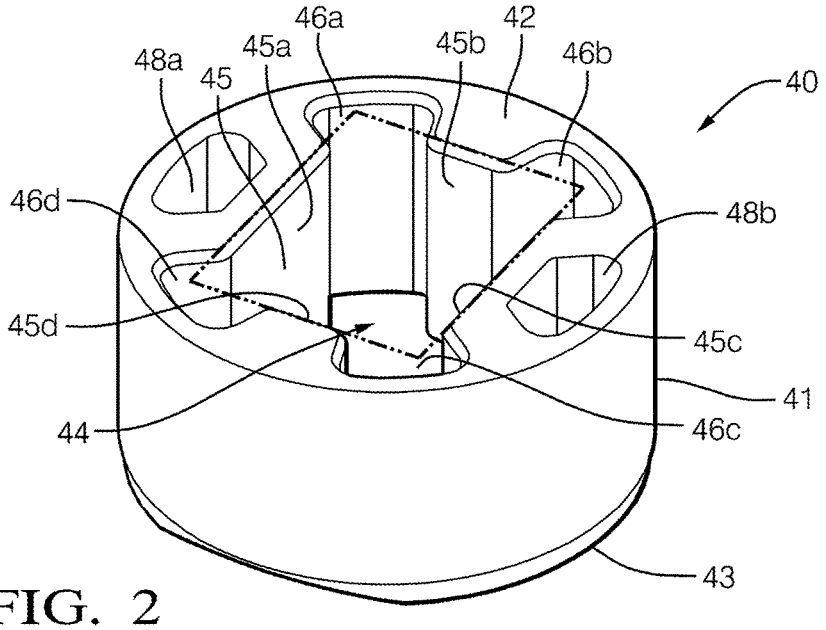
FIG. 2 is a perspective view of a guide of the drivetrain assembly for the common rail diesel pump of FIG. 1 or 4.

FIG. 2 shows an exemplary version of the guide 40. The guide 40 comprises a body 41, which in this case is substantially cylindrical in shape in order to fit directly (preferably press-fit) within a cylindrical aperture within the chamber 30 of the drivetrain housing 22. It is, however, to be appreciated that the body 41 of the guide 40 may be of any suitable external shape to correspond with either the internal shape of a chamber, or an adapter which may sit inside such a chamber.

The guide 40 comprises first and second ends 42, 43, respectively.

The guide 40 comprises a substantially centrally located aperture 44 between the two ends 42, 43. The aperture 44 is adapted to provide guided sliding contact with a cam follower shoe 16*a* of the cam follower 16.

The aperture 44 comprises an inner channel 45 extending between the first and second ends 42, 43 and defining a shape that substantially corresponds with the external shape of the cam follower shoe 16*a*. The shape of the inner channel 45 is generally defined by a plurality of disconnected internal walls 45*a-d*, which in this case comprise substantially straight walls 45*a-d* in order to define a substantially rectangular-shaped inner channel 45 (as indicated by the dotted lines). The inner channel 45 shown is configured to provide guided sliding contact with a generally rectangular-shaped cam follower shoe 16*a*. However, it is to be appreciated that a plurality of walls 45*a-d* may be shaped and contoured to define a substantially circular, or other shaped channel 45 to fit with an alternatively shaped cam follower shoe 16*a*.

In the exemplary embodiment shown, the aperture 44 further comprises a plurality of outer channels 46*a-d* extending between first and second ends 42, 43. Each of the outer channels 46*a-d* is peripheral to the inner channel 45 and communicates with the inner channel 45 along their full length between the first and second ends 42, 43. In this case, there are four outer channels 46*a-d*, one provided at each corner of the substantially rectangular-shaped inner channel 45, although it is to be appreciated that one, two, three or more outer channels 46 could be provided as long as the integrity and the shape of the inner channel 45 was neither compromised nor caused to be unsuitably shaped with respect to the cam follower shoe 16*a*. A further consideration is given to the spacing of the outer channels 46, which is approximately equal, in order to retain balanced proportions to the body 41.

The outer channels 46*a-d* are generally smoothly contoured in order to minimise stress in the guide body 41 when a side load from the cam follower shoe 16*a* is applied during rotation of the drivetrain assembly 20. In this case, the outer channels 46*a-d* comprise a plurality of short internal walls arranged to provide a generally curved internal shape. In addition, at junctions where the outer channels 46*a-d* meet with the walls 45*a-d* defining the inner channel 45, the outer channels 46*a-d* comprise short outwardly-angled walls in order to avoid a sharp edge/corner. The general shape of the outer channels 46*a-d* are chosen to maximise their volume given the shape of the body 41 and the inner channel 45, whilst limiting stress levels. In this case, given the cylindrical shape of the body 41 and the rectangular-shaped channel 45, the outer channels 46*a-d* adopt a substantially isosceles trapezoid prism shape (with curved corners).

As shown in FIG. 2, the body 41 comprises two flow passages 48*a-b* extending between first and second ends 42, 43 of the guide 40. The two passages 48*a-b* are located approximately diametrically opposite one another on the body 41 and on either side of the aperture 44. In order to maximise their volume, the flow passages 48*a-b* are provided between pairs of outer channels 46*b-c* and 46*a-d* respectively. However, it is to be appreciated that further passages 48 may be disposed between other pairs of outer channels 46, or where outer channels 46*a-d* are not provided, further passages 48 may be equally spaced around the periphery of the inner channel 45, which in that case would simply comprise the aperture 44.

The passages 48*a-b* are generally smoothly contoured in order to minimise sharp edges and corners which may cause stress. In this case, the passages 48*a-b* are shown to comprise a plurality of short internal walls arranged to provide a substantially curved internal shape. The general shape of the passages 48*a-b* are chosen to maximise their volume given the shape of the body 41 and the aperture 44. In this case, given the cylindrical shape of the body 41, the passages 48*a-b* adopt a substantially isosceles trapezoid prism shape (with curved corners).

The drivetrain housing 22 comprises a first part 22*a* enclosing the first chamber 28 and a second part 22*b* enclosing the second chamber 30. The second part 22*b* is substantially open-ended in order to receive and mount a lower part 12*a* of the pump housing 12 therein. An upper part 12*b* of the pump housing 12 sits atop the second part 22*b* of the drivetrain housing 22. Accordingly, the first and second chambers 28, 30 are substantially closed once assembled with the pump housing 12.

The closed chambers 28, 30 allow for the majority of the drivetrain housing 22 to be substantially filled with oil around the various components of the drivetrain assembly 20 and accommodated components of the pump assembly 10.

The first chamber 28 of the drivetrain housing 22 comprises a substantially cylindrical compartment of varying diameter across its length in order to contain the driveshaft 24 and the cam 26 therein.

Figure 3:
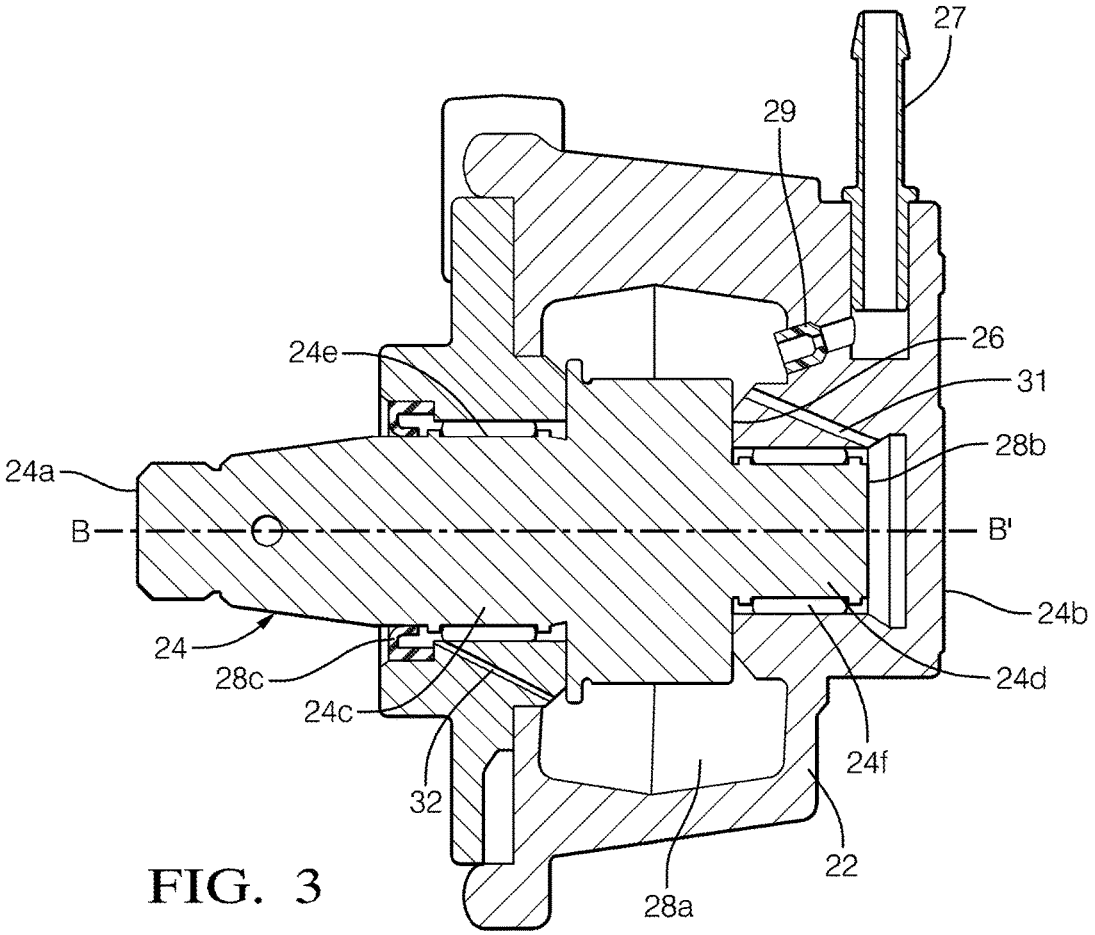
FIG. 3 is a schematic cross-sectional view of the drivetrain assembly of FIG. 1.

As shown in FIG. 3, the driveshaft 24 comprises a substantially elongate cylindrical body comprising a front bearing journal 24*c* with a front bearing 24*e* mounted thereon, and a rear bearing journal 24*d* with a rear bearing 24*f* mounted thereon.

The driveshaft 24 is attached at a first end 24*a* to a drive means (not shown), which dictates the rotational axis B-B' of the driveshaft 24 and therefore, the rotational path of the cam 26 fitted thereon.

At a second end 24*b*, the housing 22 provides a rear chamber space 28*b*. The rear bearing 24*f* is mounted (press-fit) into the housing 22 to support the rear journal 24*d* at one end of the chamber 28 in order to maintain the stability of the rotational axis B-B' of the driveshaft 24.

At the first end 24*a*, the housing 22 provides a front chamber space 28*c* adjacent the front bearing 24*e*. The front bearing 24*e* is also mounted (press-fit) into the housing 22 to support the front journal 24*c* at an opposite end of the chamber 28.

The second chamber 30 of the drivetrain housing 22 comprises a substantially cylindrical compartment of substantially equal diameter. The second chamber 30 is disposed perpendicularly to the first chamber 28 so as to be generally upstanding above the cam 26. Accordingly, the pumping axis A-A' and the driveshaft rotational axis B-B' are disposed substantially perpendicularly to one another.

The chambers 28, 30 are generally open to one another, e.g. flow of fluid is permissible between the chambers 28, 30 around the drive assembly 20 components.

Accordingly, with the driveshaft 24 and the cam 26 in situ in the first chamber 28, the first chamber 28 provides a number of spaces 28*a*, 28*b*, 28*c* around the driveshaft 24, bearings 24*e*, 24*f* and cam 26, which allow for oil flow/reservoirs for lubrication purposes.

With the plunger 14, upper end of the cam follower 16 and guide 40 in the second chamber 30, the second chamber 30 provides spaces around the plunger 14, follower 16 and guide 40 etc., which allow for oil flow/reservoirs for lubrication purposes.

In order to effect oil delivery to the chambers 28, 30 and to top-up the level of oil therein, the first part 22*a* of the drivetrain housing 22 comprises an oil inlet 27, which is connected to a supply of pressurised oil from an engine oil pump (not shown). The oil inlet 27 connects with a flow orifice 29 which delivers the oil to the first chamber 28 in the region of the cam 26. The chamber 28 provides a circumferential space 28*a* around the cam 26 and follower 16 to receive a volume of the oil.

Onward distribution of the oil to the other spaces within the first chamber 28 and to the second chamber 30 is effected by natural flow between the components in addition to a number of drillings or flow conduits.

In an exemplary embodiment, the first part 22*a* of the housing 22 comprises a rear bearing drilling 31 between the circumferential chamber space 28*a* and the rear chamber space 28*b* in order to adequately circulate a cooling flow of oil to the mounting (interface) of the rear journal 24*d* within the rear bearing 24*f*. The first part 22*a* of the housing 22 also comprises a front bearing drilling 32 between the front chamber space 28*c* and the circumferential space 28*a* in order to adequately circulate a cooling flow of oil to the mounting (interface) of the front journal 24*c* within the front bearing 24*e*.

The communication between the circumferential space 28*a* of the first chamber 28 and the second chamber 30 provides a flow of oil upwardly into the second chamber 30. This upward flow of oil is facilitated primarily by the flow passages 48 and the outer channels 46 of the guide 40 around the cam follower 16.

In the exemplary embodiment shown, the oil inlet 27 is disposed so as to enter the first part 22*a* of the housing 22 towards a top of the first part 22*a* of the first chamber 28. Distribution of the oil throughout the chambers 28, 30 can then use natural fluid hydrodynamics to flow into the various unoccupied spaces 28*b*, 28*c*, 30 and fill up the housing 22. This, however, is not essential and the oil inlet 27 may be provided at another location, but always with the aim of retaining oil within at least the first chamber 28 of a stationary pump.

In the embodiment shown, an oil outlet 33 is disposed so as to exit the second part 22*b* of the housing 22 towards a top of the second part 22*b*, but below the housing 12 of the pump 10, in order to provide a natural overflow out of the second chamber 30, whilst retaining a substantially oil-filled condition to the housing 22. Upon first-filling, flow and top-up events, distribution of the oil from the inlet 27 and throughout the chambers 28, 30 will fill the housing 22 until the oil level reaches the outlet 33, at which point any excess oil is provided with an escape route.

In the embodiment of FIG. 1, surfaces of the front bearing 24*e* and the rear bearing 24*f* are cooled by passive cooling events. However, a passive cooling flow is not always sufficient to provide the necessary temperature reduction to the bearings.

Figure 4:
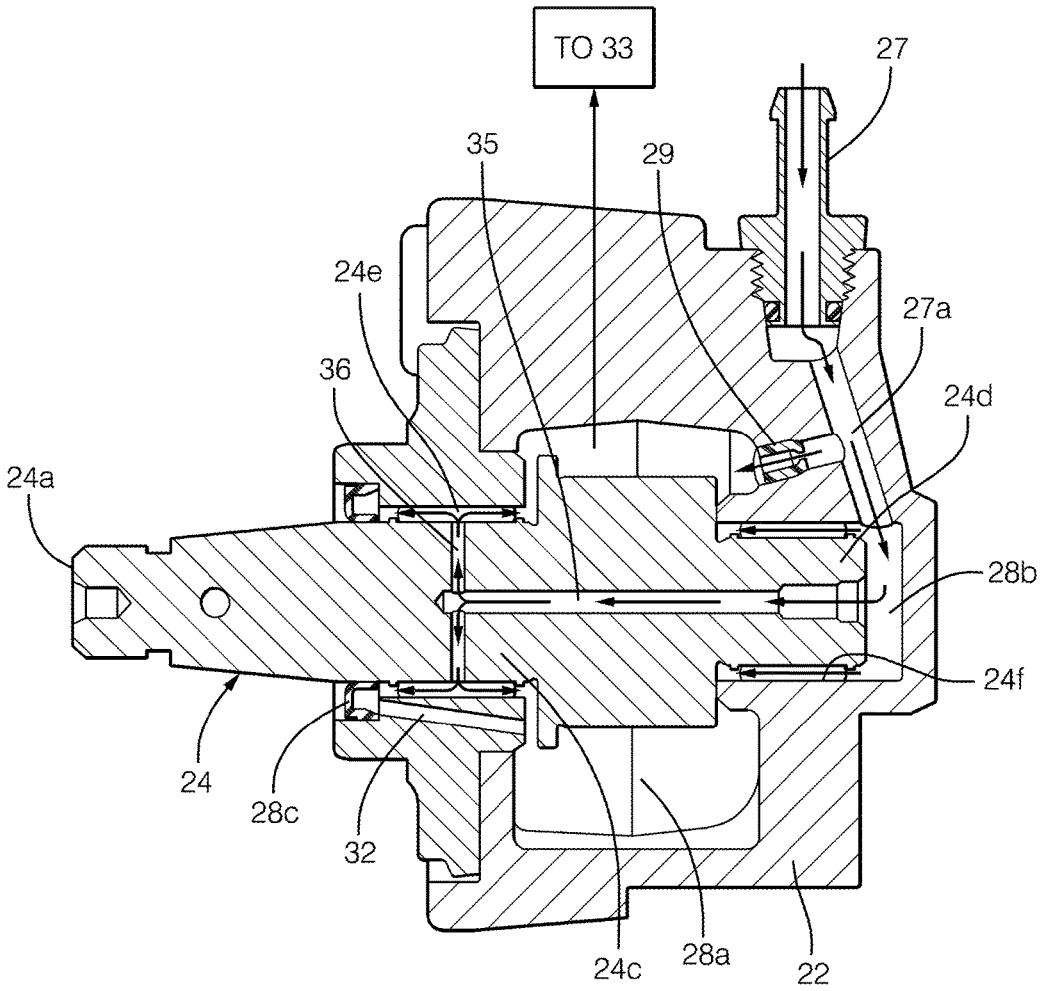
FIG. 4 is a schematic cross-sectional view of a common rail diesel pump comprising a drivetrain assembly according to an alternative embodiment of the invention.

FIG. 4 shows an alternative embodiment of the present invention using forced flow events to cool the surfaces of the bearings, for situations where passive flows through the bearings are not sufficient to keep the bearings sufficiently cool, To effect forced cooling flow across the bearings, an additional conduit 27*a* is employed between the inlet 27 and the rear chamber space 28*b*. This facilitates forced flow of oil between the rear bearing 24*f* and the respective journal 24*d*. Furthermore, a channel 35 through the axis of the driveshaft 24 onwardly delivers oil from the rear chamber space 28*b* to a lubrication channel 36 through the front journal 24*c* providing forced flow of oil to the front bearing 24*e* and the front journal 24*c*. In this case the drilling 32 between the front chamber space 28*c* and the circumferential chamber space 28*a* of the cambox functions to relieve the 4 bar flow pressure from acting on the seal. However, the passive approach is preferred since flow variation will increase demands on engine oil pump if forced flow is utilised.

In the embodiment of FIG. 4, the outlet 33 is in a similar position to that shown in respect of the embodiment of FIG. 1.

In the embodiments of FIGS. 1 and 4, the oil inlet 27 receives oil, which has been pressurised by the engine oil pump, though a feed pipe (not shown) from a cleaned source of oil, e.g. from the clean side of an oil filter within the engine. The oil outlet 33 returns oil though a feed pipe (not shown) to a low-pressure uncleaned source of oil, e.g. to a crankcase of the engine (not shown).

The oil inlet 27 and associated pressurised feed pipe (not shown) is generally of smaller diameter than the unpressurised oil outlet 33. An unrestricted flow of oil out of the housing 22 is enabled, which is expected to be at, or less than atmospheric pressure.

In an alternative embodiment, the oil inlet 27 comprises a further oil filter before oil enters the housing 22.

In the exemplary embodiments, the cam follower 16 comprises a substantially rectangular shoe 16*a*, sized to fit snugly within the guide 40 (the guide 40 is shown most clearly in FIG. 2), within the inner channel 45 as defined by the inner channel walls 45*a-d*. The corners of the shoe 16*a* are not bounded by walls as they move within the open volume of the outer channels 46*a-d* without any substantial contact with walls of the outer channels 46*a-d*. The inner channel walls 45*a-d* are sufficient to retain a sliding engagement of the shoe 16*a* within the inner channel 45 and along the pumping axis A-A' without any significant lateral movement or twisting.

The use of a rectangular shoe 16*a* enables a stable sliding engagement with the guide 40, whilst providing a smaller footprint than a traditional round tappet. This smaller footprint of the shoe 16*a* provides a lesser degree of fluid (oil) displacement within the chambers 28, 30 of the drivetrain housing 22 as it moves up and down the pumping axis A-A'.

The shoe 16*a* provides an internal cylindrical cavity 16*c* accessed via an underside of the shoe 16*a*. The cavity 16*c* accommodates an upper portion of a roller 16*b*, which roller 16*b* sits atop the cam 26 and eases the translation (by reducing friction) of the rotational movement of the cam 26 to the linear reciprocating movement of the shoe 16*a* and therefore, the plunger 14. As the cam 26 rotates, the roller 16*b* rides along the surface of the cam 26 by spinning within the cavity 16*c* of the shoe 16*a*.

When the engine in which the pump 1 of either embodiment of the present invention is installed is switched off, the pump 1 will tend partially to drain of oil. The oil in the pump 1 will drain down to whichever is the lowest of the inlet and outlet connectors. Accordingly, both the inlet 27 and outlet 33 must be located sufficiently high up in the pump 1 to ensure that the drivetrain housing 22 does not drain completely of oil when the engine is switched off. Specifically, the inlet 27 and outlet 33 must be located to ensure that oil is largely maintained within the first chamber 28, and therefore around the region of the roller 16*c*, for when the engine re-starts.

Therefore, in the described embodiments, the inlet 27 and outlet 33 are located in the drivetrain housing 22, above the roller 16*c*.

However, in alternative embodiments, for example if the pump 1 is to be installed in an engine in a different orientation to that shown in the Figures, the inlet 27 and outlet 33 would be relocated, to ensure oil is maintained around the region of the roller 16*c* as above.

The drivetrain housing 22 is generally shaped to minimise the space taken up by the pump 1 within an engine. As such, the housing 22 generally resembles a bisecting cylinder arrangement to reduce the volume of the housing 22 within an engine.

In use, the shoe 16*a* sits snugly within the inner channel 45 of the guide 40. As the cam 26 rotates (driven by rotation of the driveshaft 24), the roller 16*b* rides along the cam 26 to provide a low-friction, reciprocating linear movement along axis A-A' to the shoe 16*a* in which the roller 16*b* is partially housed, and thereon to the plunger 14.

As the cam 26 rotates, oil is naturally displaced within the cavity 28.

Further oil displacement is caused by the linear movement of the roller 16*b*/shoe 16*a* as oil is forced upwardly within the second chamber 30 by the solid body of the shoe 16*a*. Any resultant pressure pulses are minimised since flow passages 48 provided within the guide 40 reduce the impact of the oil displacement by allowing for oil to backflow relative to the shoe 16 direction as opposed to being forced in one direction. Further control of the oil displacement is provided by the rectangular configuration of the shoe 16*a*, which allows for a smaller shoe 16*a* with sufficient surface area and load capacity to withstand the pumping events, thereby providing a smaller surface area and volume to effect oil displacement. Pressure fluctuations are therefore, kept to a minimum.

In the present invention, the oil-filled drivetrain housing 22 ensures immediate lubrication is available following a stationary event, as opposed to waiting for oil pressure rises at a starting event. In addition, there are a variety of mounting angles available to the vehicle manufacturer and vehicle tilt is not limited due to the oil-filled housing 22.

Although a few preferred embodiments have been shown and described, it will be appreciated by those skilled in the art that various changes and modifications might be made without departing from the scope of the invention, as defined in the appended claims.

The invention claimed is:

1. An oil lubricated common rail diesel pump comprising:
- a pumping assembly; and
- a drivetrain assembly;
- the pumping assembly comprising:
  - a pump housing; and
  - a plunger mounted along a pumping axis;
- the drivetrain assembly comprising:
  - a driveshaft;
  - a drivetrain housing having a first chamber and a second chamber;
  - a cam mounted within the first chamber, the plunger being arranged for reciprocating linear movement along the pumping axis within the second chamber upon rotation of the cam; and
  - a guide mounted within the drivetrain housing between the cam and the plunger and being adapted to receive a cam follower; wherein at least the drivetrain housing is adapted to be substantially filled with oil in use and the guide comprises at least one flow passage communicating between the first chamber and the second chamber of the drivetrain housing, wherein the guide comprises a guide body comprising first and second ends and the at least one flow passage extends between the first and second ends and is open at both the first and second ends and the guide also comprises a substantially centrally located aperture extending between the first and second ends of the guide and open at both the first and second ends to provide guided sliding contact with the cam follower and wherein the drivetrain housing comprises an oil inlet adapted to deliver oil to the first chamber of the drivetrain housing in a region of the cam.

2. The oil lubricated common rail diesel pump according to claim 1, wherein each of the at least one flow passage is disposed within a peripheral portion of the guide body towards an outside wall or walls of the guide body.

3. The oil lubricated common rail diesel pump according to claim 1, wherein the guide comprises at least two flow passages approximately equally spaced from one another around the peripheral portion of the guide body.

4. The oil lubricated common rail diesel pump according to claim 1, wherein the centrally located aperture comprises an inner channel extending between the first and second ends.

5. The oil lubricated common rail diesel pump according to claim 4, wherein the aperture comprises at least one outer channel provided around a periphery of the inner channel and communicating with the inner channel between the first and second ends.

6. The oil lubricated common rail diesel pump according to claim 5, wherein each of the at least one flow passage and each of the at least one outer channel are approximately equally spaced around the periphery of the inner channel.

7. The oil lubricated common rail diesel pump according to claim 1, wherein the drivetrain housing comprises a first part comprising the first chamber and a second part comprising the second chamber, wherein the first chamber and the second chamber chambers are open to one another.

8. The oil lubricated common rail diesel pump according to claim 7, wherein the oil inlet is disposed so as to enter the first part of the housing towards a top of the first part of the drivetrain housing.

9. The oil lubricated common rail diesel pump according to claim 7, wherein an oil outlet is disposed in the second part of the drivetrain housing.

10. The oil lubricated common rail diesel pump according to claim 9 wherein the oil inlet and the oil outlet are disposed above the first chamber or at the top of the first chamber.

11. The oil lubricated common rail diesel pump according to claim 1, wherein cooling of one or more bearings of the oil lubricated common rail diesel pump comprises passive flow events or forced flow events.

12. A drivetrain assembly for an oil lubricated common rail diesel pump, the drivetrain assembly comprising:

a driveshaft;

a drivetrain housing having a first chamber and a second chamber, the second chamber adapted to receive a reciprocating plunger;

a cam mounted within the first chamber; and a guide mounted within the drivetrain housing above the cam and being adapted to receive a cam follower wherein the guide comprises a substantially centrally located aperture extending between first and second ends of the guide and open at both the first and second ends to provide guided sliding contact with the cam follower in the same direction as the reciprocating plunger;

wherein the drivetrain housing is adapted to be substantially filled with oil in use and the guide comprises at least one flow passage communicating between the first chamber and the second chamber of the drivetrain housing.

13. A guide of a drivetrain assembly for an oil lubricated common rail diesel pump, the guide being adapted to be mounted within a drivetrain housing above a cam and being adapted to receive a cam follower, wherein the guide comprises at least one flow passage therethrough between a first and second end thereof and also comprises a substantially centrally located aperture extending between first and second ends of the guide and open at both the first and second ends to provide guided sliding contact with the cam follower.

* * * * *